United States Patent [19]

Bocci et al.

[11] 4,440,976

[45] Apr. 3, 1984

[54] AUTOMATIC SELECTION OF DECRYPTION KEY FOR MULTIPLE-KEY ENCRYPTION SYSTEMS

[75] Inventors: Paul M. Bocci, Hoffman Estates; Terence E. Sumner, Roselle; James R. Wojnarowski, Cary, all of Ill.

[73] Assignee: Motorola, Inc., Schaumburg, Ill.

[21] Appl. No.: 274,696

[22] Filed: Jun. 17, 1981

[51] Int. Cl.[3] ..... H04K 1/00

[52] U.S. Cl. ..... 179/1.5 R; 178/22.13; 455/26

[58] Field of Search ..... 179/1.5 R; 455/26; 178/22.13, 22.17, 22.18, 22.19; 343/6.5 R

[56] References Cited

U.S. PATENT DOCUMENTS

| | | | |
|---|---|---|---|
| 3,893,031 | 7/1975 | Majeau et al. | 179/1.5 R |
| 3,983,327 | 9/1976 | Gannett et al. | 179/1.5 R |
| 3,995,225 | 11/1976 | Horn | 329/106 |
| 4,068,089 | 1/1978 | Kuhnlein et al. | 178/22.18 |
| 4,133,973 | 1/1979 | Branscome et al. | 178/22.18 |
| 4,172,213 | 10/1979 | Barnes et al. | 178/22.19 |
| 4,176,246 | 11/1979 | Gaetzi | 178/22.13 |
| 4,182,933 | 1/1980 | Rosenblum | 178/22.17 |
| 4,197,502 | 4/1980 | Sumner et al. | 375/75 |
| 4,223,182 | 9/1980 | Fraser | 179/1.5 R |

OTHER PUBLICATIONS

Science, vol. 197c7(77), pp. 438–440.

*Primary Examiner*—Sal Cangialosi

*Attorney, Agent, or Firm*—Charles L. Warren; Edward M. Roney; James W. Gillman

[57] ABSTRACT

A receiver of digitally encoded voice signals that may be encrypted according to a plurality of keep subjects a received signal to decryption according to each of the keys. Decrypted signals are tested for the presence of modulation, and the signal, if any, that is decrypted is recovered for use. If it is desired, a visual indication may tell a user which key is being used to decrypt the signal.

9 Claims, 7 Drawing Figures

96
106
102
97

40
$V_{DD}$
44
34
92
84
38
72
104
90
$V_{DD}$
46
36
302
94
74
42
$V_{DD}$
80
62
76
66
$V_{DD}$
82
64
78
68
326
124
322
324
320
108
70
50

AUTOMATIC SELECTION OF DECRYPTION KEY FOR MULTIPLE-KEY ENCRYPTION SYSTEMS

BACKGROUND OF THE INVENTION

This invention relates to digitally encoded voice signals. In particular, it is a method and means for automatic selection of one of a plurality of digitally encoded bit streams that has been decoded.

Radio communications among fixed stations, mobile units and portable units cannot be greatly localized in direction without losing the possibility of coverage as the mobile or portable units change locations. Such communications are therefore easily intercepted by an eavesdropper. if security of communications is important to the user, it can be achieved by a system such as the Motorola Digital Voice Protection System. This is a system that converts an electrical analog of a voice signal into a digital bit stream by continuously-variable-slope delta (CVSD) modulation. The digital bit stream is then scrambled or encrypted by a system to which only the sender and authorized receivers are given keys. When such a system is in use, the eavesdropper may detect the signals, but he receives no more than a pseudorandom signal resembling noise because he lacks means to decrypt the signal.

The user of a two-way radio having a digital encryption system such as the Motorola Digital Voice Protection System needs first to be able to listen to clear signals in his channel and to be able to respond with a clear transmission. The term "clear" is here used to denote analog modulation that is typically frequency modulation in the channels of interest. The user also needs to be able to detect and respond to signals that are encoded in binary form and then scrambled. Detection of the presence of digital signals can be carried out by a system such as that of U.S. Pat. No. 3,995,225, which is assigned to the assignee of the present invention. That patent is incorporated here by reference as if set forth fully herein.

If receiver circuitry has detected the presence of a binary signal, it is next necessary to submit it to an unscrambling process. This requires that the user have available a decrypting system containing the key with which the message was encrypted. If he does and if he applies the message to such a system, the decrypted signal will be a binary signal that represents delta modulation by an audio signal. The delta modulation may be continuously variable-slope delta (CVSD) modulation. If the user has not had the proper key, the result of subjecting the signal to a decryption process with the wrong key will be to produce a signal with noise-like properties. A decrypted signal can be distinguished from a signal that has not been decrypted by a circuit such as the one of U.S. Pat. No. 4,197,502, assigned to the assignee of the present invention. That patent is incorporated here by reference as if set forth fully herein. The circuit of that patent provides a signal which can be used to mute a receiver if a digital signal has not been decoded and to enable the receiver if the signal has been decoded.

The foregoing combination of operations provides a thorough measure of voice protection in the scrambled mode, while allowing the user to communicate in the clear with other users who either do not have or do not choose to use a scrambled mode. It is sometimes desirable in such systems to maintain different levels of security. A supervisor, for example, might wish to deliver a scrambled message to one user or a set of users without communicating with another set of users on the same channel. This has been accomplished by allowing the supervisory transceiver to have a plurality of scramblers and to select among them manually. The same feature has been extended to mobile and portable units in which manual selection has been made of one of a plurality of unscramblers. Manual selection is the method of choice with a supervisory transmitter or other unit that originates calls. It is a disadvantage, however, for the unit receiving calls in that a muting system of the type described above will leave the called unit unaware that it is being called in a scrambled mode to which it has not selected the key.

One solution to this problem is to call a remote unit in the clear and identify a particular key that is to be used to unscramble an ensuing message. This represents a compromise in security in that the clear transmission alerts eavesdroppers to the fact of traffic between the units even if they are later unable to decrypt the message. Another means of establishing communication is to reserve one particular key as a supervisory channel and to use that key to instruct users to select another key for incoming messages. This requires that the user select the channel for the incoming message and then remember to return his key selection to the supervisory channel. It is evident that each of these methods represents a level of undesired complexity of operation.

It is an object of the present invention to provide a method and means of automatic selection of a decrypted signal.

It is a further object of the present invention to provide automatic selection of one encrypted signal that has been subjected to a plurality of decryption schemes, including one that decrypts the signal.

Other objects will become apparent in the course of a detailed description of the invention.

SUMMARY OF THE INVENTION

A receiver for digital signals that is adapted to decrypt signals encrypted according to a plurality of different keys subjects the encrypted signal simultaneously to decryption according to each of the keys available to the receiver. If the encrypted signal is decrypted by the wrong key in any one of decryption unit, the resulting signal will not be passed further for conversion into audio. If one of the plurality of decryption units available to the receiver contains the proper key for decrypting the signal, then the signal coming from that unit will be decrypted properly and will be passed for conversion into audio. Selection of the proper signal is automatic. If the receiver receives an encrypted signal for which it does not have the key, the audio will be muted. In one embodiment of the invention, a receiver that is receiving an encrypted signal for which it has a key will not only decrypt that signal but will also identify the particular key that is in use. The automatic selection process may be sequential in time, which can be adequate for two or three different keys, or it may be parallel in time, a method that can deal with an unlimited number of keys.

DETAILED DESCRIPTION OF THE INVENTION

Figure 1:
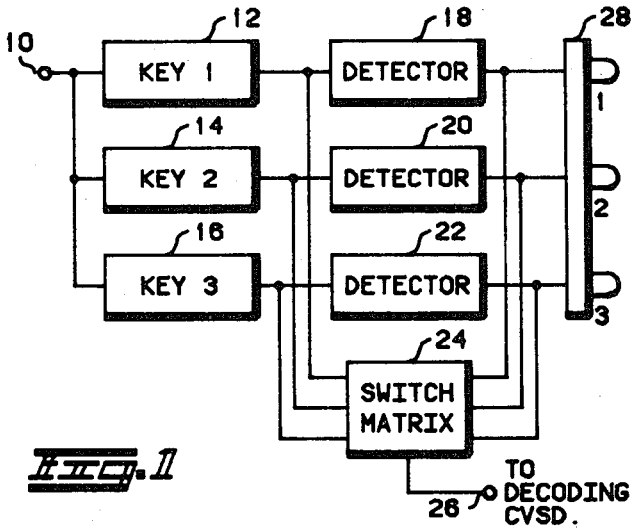
FIG. 1 is an overall block diagram of one embodiment for the practice of the present invention.

FIG. 1 is a block diagram of an embodiment of the invention. It is of particular utility when a receiver that includes digital voice protection is to receive and decode transmissions automatically when the transmissions it is receiving may have been sent in a plurality of enciphering keys. However, the circuit of FIG. 1 is not adapted to relate a transmitting channel to a particular channel that has been received and decrypted or to enable encrypted transmission. In FIG. 1, terminal 10 receives a digital signal that has been encrypted according to some key. This key may meet the requirements of the Data Encryption Standard (DES) of the National Bureau of Standards, or it may be encrypted to other known standards. The signal at terminal 10 is applied to a plurality of encode-decode modulues 12, 14 and 16 that are placed in parallel. FIG. 1 shows three encode-decode modules, but it should be evident that a user could parallel as many such modules as was desired. Encode-decode module 12 is set to decrypt an incoming digital signal according to a first key, here denoted key 1. Similarly, encode-decode module 14 decrypts an input signal according to key 2, and encode-decode module 16, key 3. The output of encode-decode module 12 is taken to a delta-modulation detector 18 where it is tested for the presence of delta modulation in the signal that has been produced by encode-decode module 12. Similarly, the output of module 14 is applied to delta-modulation detector 20, and the output of module 16 is applied to delta-modulation detector 22. In each case, the only signal that will comprise delta modulation at the output of a module 12, 14 or 16 will be a signal that has been decrypted. A signal that was encrypted according to any key other than keys 1, 2 or 3, will not be decrypted and will appear to be noise in the outputs of modules 12, 14 and 16. If one signal is decrypted, the delta-modulation detector 18, 20 or 22 for the appropriate channel will send a signal to switch matrix 24 which selects an output from the appropriate encode-decode module 12, 14 or 16 for connection through switch matrix 24 to output terminal 26. The signal at terminal 26 is encoded with delta modulation, preferably of an adaptive form, such as continuously-variable-slope delta modulation (CVSD). It is applied to a circuit that recovers audio for the user. In some types of operation, it may be desired to have the user unaware of what decrypting key is being applied to the message that he receives. The circuit just described will accomplish this. In the alternative, it may be desired to inform the user of the particular key number that was used to encrypt the message that he is receiving. This can be accomplished by display unit 28 which is adapted to display a visual indication such as a light in response to a signal from the particular delta-modulation detector 18, 20 or 22 that signals receipt of a decrypted signal. This provides an operator with a combination of automatic decrypting and information sufficient for him to make manual selection of the same key to make a return transmission.

Figure 2:
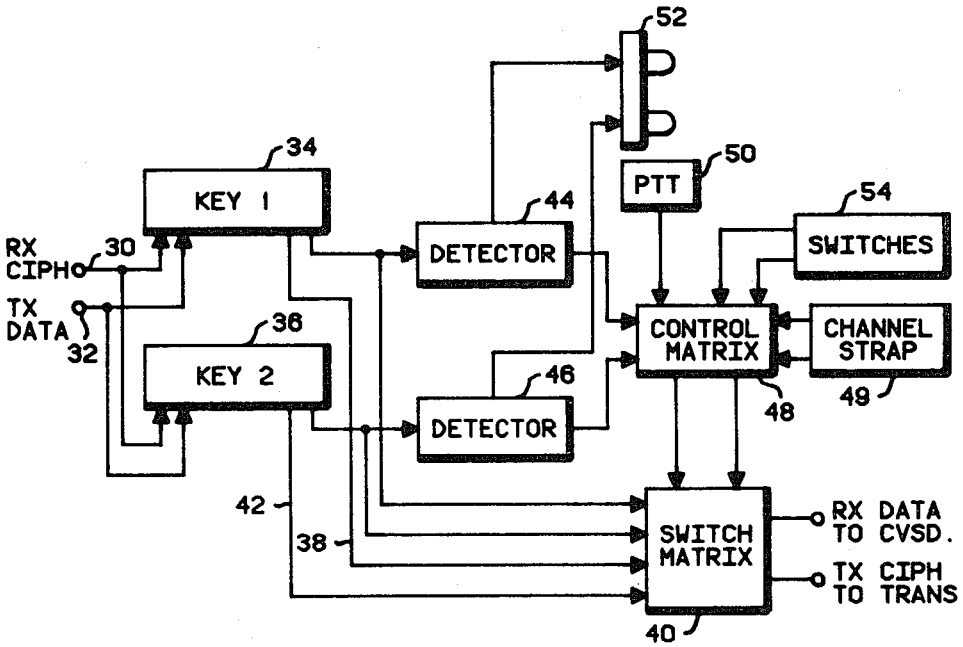
FIG. 2 is a block diagram of an alternate embodiment for the practice of the present invention.

FIG. 2 is a block diagram of an alternate embodiment of the invention. In FIG. 2, a terminal 30 receives encrypted digital data in a Digital Voice Protection System. This typically follows stages of RF amplification, mixing, IF amplification and detection, and also follows some type of circuit that decides whether it is receiving analog or digital data. One such circuit is taught in U.S. Pat. No. 3,995,225, which is assigned to the assignee of the present invention. Such a circuit is capable of switching a clear signal to be amplified and converted to sound while directing digital data to terminal 30. FIG. 2 also includes la terminal 32, which receives a signal to be transmitted that has been converted by a CVSD modulator to digital form. The signal at terminal 30 is thus a received signal that is digital in form and is encrypted, while the signal at terminal 32 is a signal to be transmitted that is digital in form, but not encrypted. Both these signals are coupled to a plurality of encoder-decoder units 34 and 36. Only two are shown here, but as in FIG. 1, a user can parallel as many encode-decode units as he needs to receive signals encrypted according to whatever keys he is authorized to use. The units could also be connected one at a time and sampled in time sequence. It is supposed here that encode-decode unit 34 encodes and decodes according to key 1, and encode-decode unit 36 encodes and decodes according to key 2. A digital signal encoded according to key 1 is then taken on line 38 to a switch matrix 40, and a digital signal encoded according to key 2 is taken to switch matrix 40 on line 42. Each of these encryptions is thus available for selection at switch matrix 40. A signal that is decrypted according to key 1 is applied to delta-modulation detector 44, and one that is decrypted according to key 2 is applied to delta-modulation detector 46. If either detector 44 or 46 detects delta modulation, indicating that it has received a decrypted signal, it generates a control signal that is coupled to control matrix 48. Control matrix 48 is connected to switch matrix 40 to pass decrypted data in a receive mode and to select data according to a desired encryption key in a transmit mode. It is also connected to channel strap 49 if it is desired to associate a particular key with a particular channel. A decision between transmitting and receiving is made by a means such as push-to-talk switch 50. Control matrix 48 or delta modulation detectors 44 and 46 may also control a visual indication of keys received as at display 52. Selection of an encryption key for transmission may be made automatically based upon the particular channel selected or it may be made manually as by switch 54. Control matrix 48 and switch matrix 40 are indicated as matrices both because each performs a plurality of functions and because each is thus more readily adapted for the addition of more keys if it is desired.

Figure 3A:
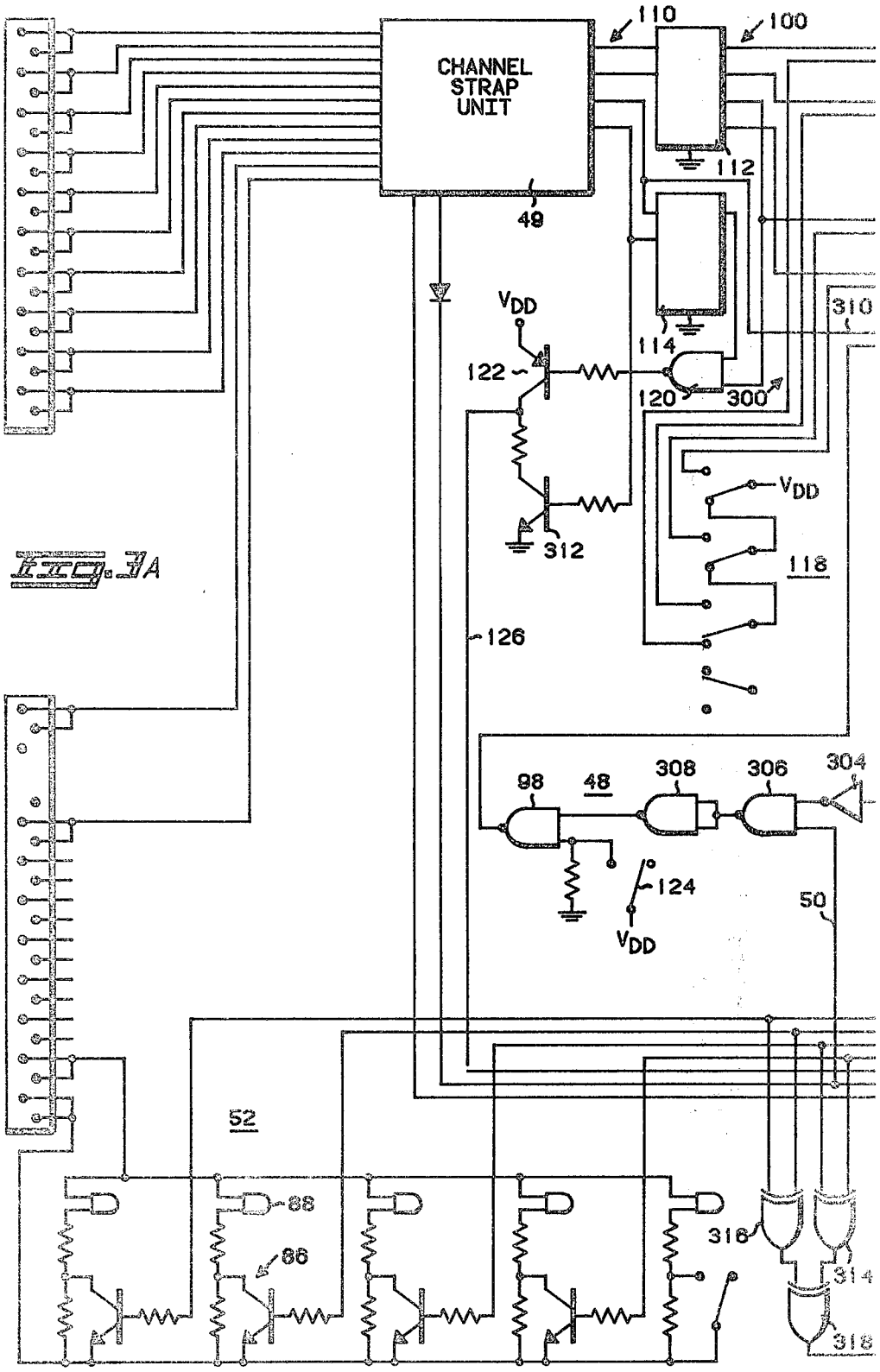
FIGS. 3A and 3B are a detailed circuit diagram of an embodiment of the block diagram of FIG. 2.
Figure 3B:
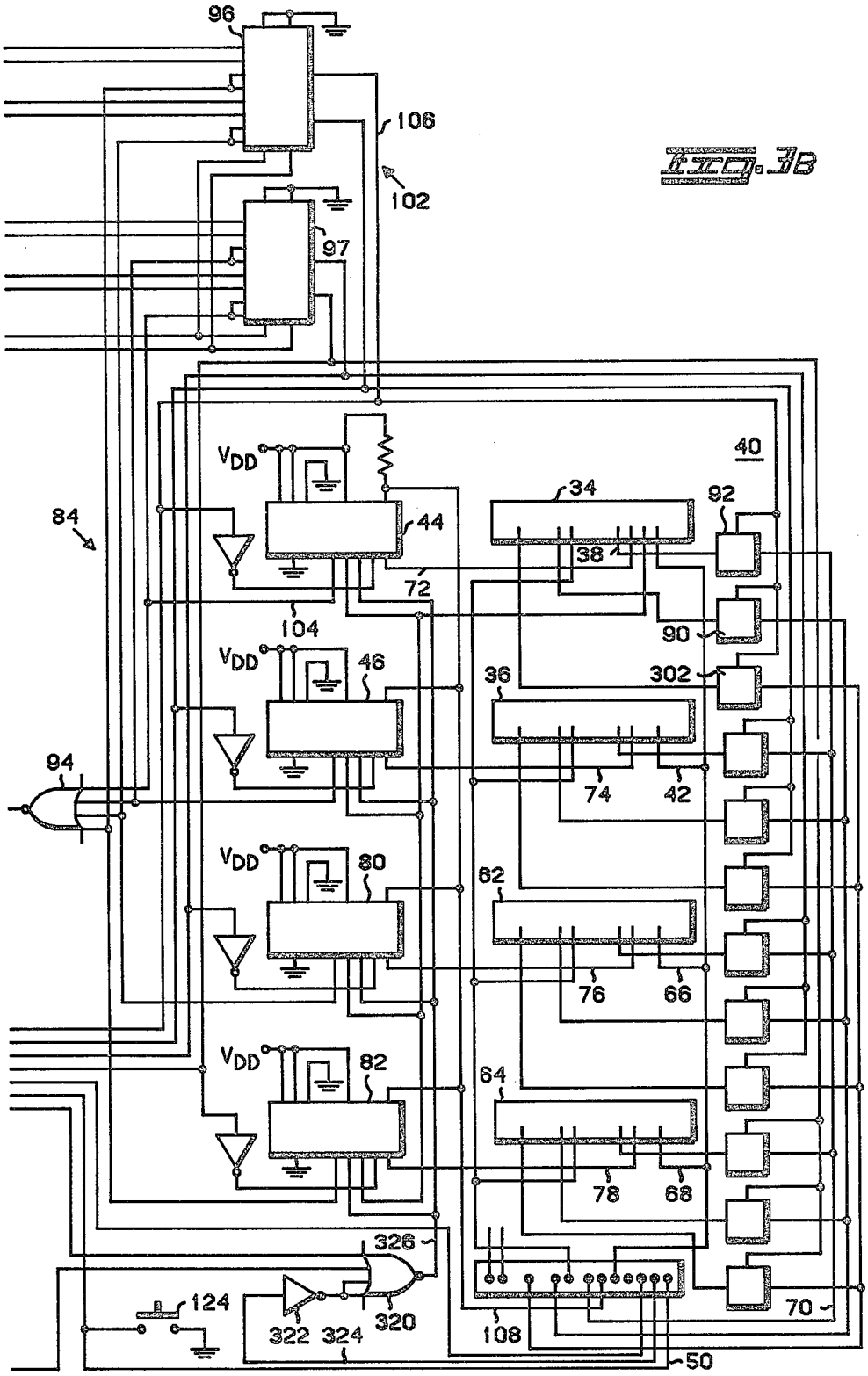

FIG. 3 is a detailed circuit diagram of an embodiment of the block diagram of FIG. 2. Elements of FIG. 3 are collected and given the numbers of FIG. 2 to relate the functions of FIG. 2 to the detailed circuit embodiment of FIG. 3. In FIG. 3 a received, digitally encoded, ciphered signal is applied at terminal 30 and is taken to a plurality of encode-decode units 34, 36, 62 and 64 for decoding. Similarly, a signal to be transmitted that has been encoded with CVSD modulation but that has not been encrypted is applied at terminal 32 where it is taken to encode-decode units 34, 36, 62 and 64 for encryption. Where FIG. 2 shows two encode-decode units, FIG. 3 has four. This is a matter of design choice and convenience. As stated earlier, the encode-decode units 34, 36, and also 62 and 64 are of types that are well known. They may be adapted to encrypt and decrypt according to the Data Encryption Standard (DES) or they may follow some other encryption and decryption scheme as chosen by the circuit designer. Encrypted data leaves the encode-decode units on lines 38, 42, 66 and 68 and is taken to switch matrix 40 where it is switched to line 70 to be sent to a transmitter for transmission. Data that has been subject to each of the decryption keys is taken on lines 72, 74, 76 and 78 respectively to delta-modulation detectors 44, 46, 80 and 82. If one of these delta-modulation detectors detects the presents of delta-modulation, it places a signal on the appropriate line 84. That signal goes in control matrix 48 to NOR gate 94 and to one of the sets of inputs of multiplexers 96 and 97. The output of NOR gate 94 is taken to NAND gate 98 from which an output switches multiplexers 96 and 97. Multiplexers 96 and 97 have three sets of inputs. One set of inputs is the logical signal on lines 84 indicating the key that has been decoded. Another input to multiplexers 96 and 97 is a set of inputs on lines 100 that allow a particular key to be selected for decrypting a received signal according to the channel that is selected. The third input is lines 300 from the manually selected switches. Thus, multiplexers 96 and 97 select a signal on one of lines 84 if the transceiver is in the auto-receive mode and it selects a signal on one of lines 100 if in the channel-strap mode or from lines 300 if in the manual mode.

The selected lines are coupled into lines 102 to accomplish several functions. To explain those functions, suppose that delta-modulation detector 44 is the only one that receives a decrypted signal. That signal is thus delta-modulated. This places a logical signal on line 104 that in turn is passed through multiplexers 96 and 97 and appears on line 106. This is connected to lamp amplifier 86 of display 52 to light lamp 88. The signal is also taken to switch matrix 40 where it operates switches 90, 92 and 302. Switches 90 and 302 are used only to load a key into encode-decode unit 34. Switch 92 passes data on line 38 to the transmitter to be transmitted. The signal on line 106 also is returned to delta-modulation detector 44 where it enables the passage of a decrypted signal to line 108 which is connected to a CVSD receiver.

Control matrix 48 accomplishes several other functions which are described here. When the transceiver is transmitting and when the channel strapping function is used, there will be an input on appropriate ones of lines 110 to decoder 112 and decoder 114. Decoder 112 converts a binary input identifying the key to be used into a signal on an appropriate one of the four output lines that is taken to multiplexers 96 and 97. One set of inputs to multiplexers 96 and 97 is generated by switch array 118 which allows manual selection of a key.

Switch 124, through gate 98, allows key selection to be done either manually or automatically. Automatic selection occurs only when a signal is present as determined by a true output from one of the delta-modulation detectors 44, 46, 80 and 82. Gate 94 provides the indication through inverter 304. The transceiver must also be in the receive mode for automatic operation to be allowed. Transmit indication is provided by PTT line 50 and is combined with the output of 304 in gates 306 and 308. The output of gate 308 and of switch 124 are combined in gate 98 to give the manual-auto control signal to multiplexers 96 and 97.

When manual operation is either forced by PTT line 70 or selected by switch 124, manual key selection can come from either manual switches 118 through line 300 or from channel strap decoder 112 through line 100. Which of these modes is chosen is determined by line 310, one of lines 110, so that manual selection can occur either from switches 118 or from channel selection through line 110.

Channel strap information on some of lines 110 along with inputs of decoders 112 and 114 are conbined in gate 120 and amplifiers 122 and 312 to create a mode signal on line 126 which is used to control the transmit mode of the transceiver. This allows channel-select information to be used to force either enciphered or clear transmissions on certain channels. This ensures that operation on a certain channel will be either enciphered or clear as desired.

Should falsing of the code detectors 44, 46, 80 and 82 occur, causing more than one of lines 84 to indicate CVSD modulation, more than one encode-decode output could be enabled by line 102. This condition is detected by gates 314, 316 and 318. These gates produce a signal in gate 320 which, combined with line 324 through inverter 322, provides a signal at line 326 to reset the modulation detector forcing all of the outputs to be reset. This allows only the correct detector to produce an output again to resume proper operations. Line 324 from the transceiver indicates that an encrypted signal is present. When such a signal is not present, the detector 44, 46, 80 and 82 are held in a reset condition.

Figure 4:
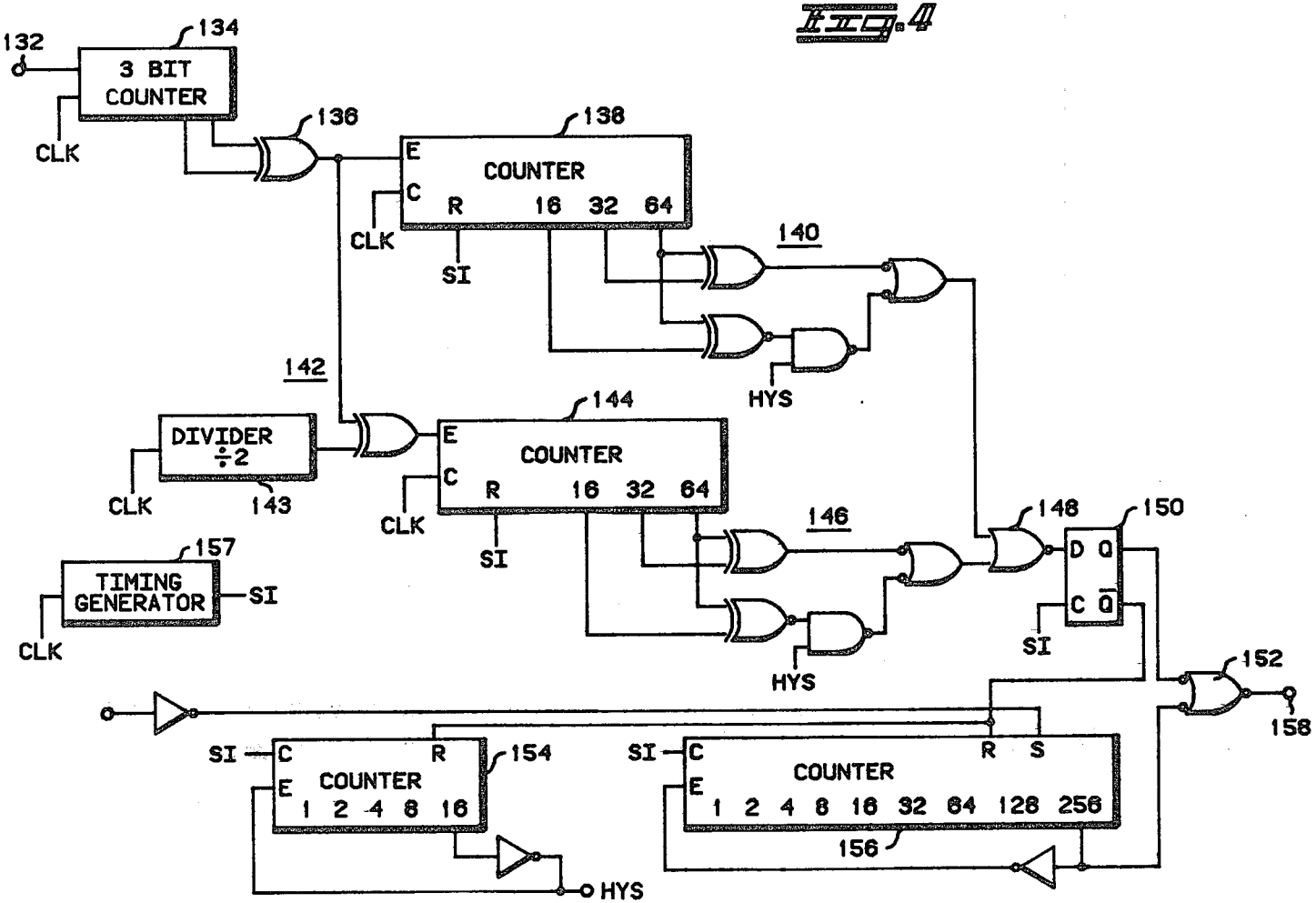
FIG. 4 is a block diagram of one of the delta-modulation detectors of FIG. 3.
Figure 5A:
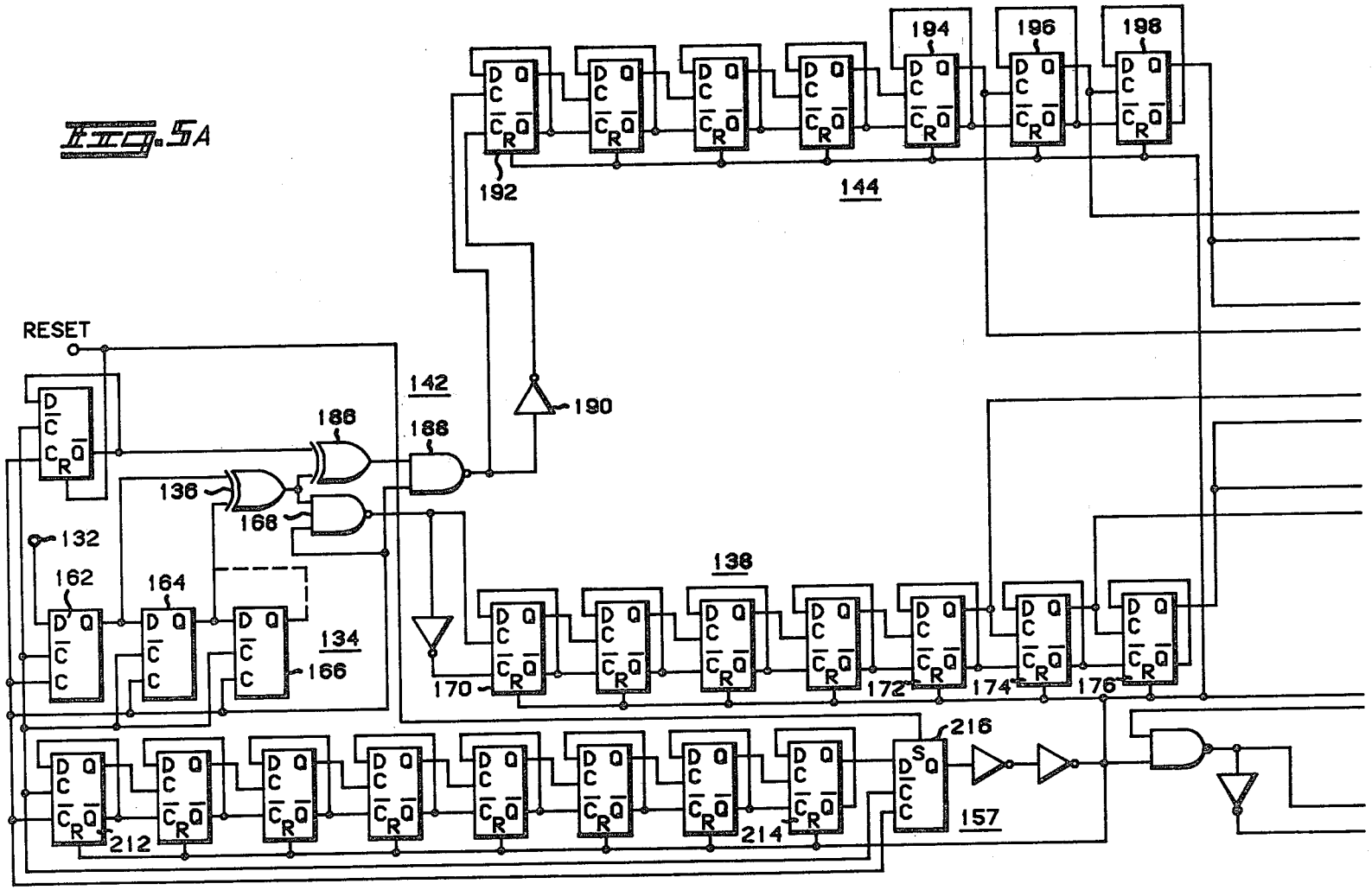
FIGS. 5A and 5B are a detailed circuit diagram of the delta-modulation detector of FIG. 4.
Figure 5B:
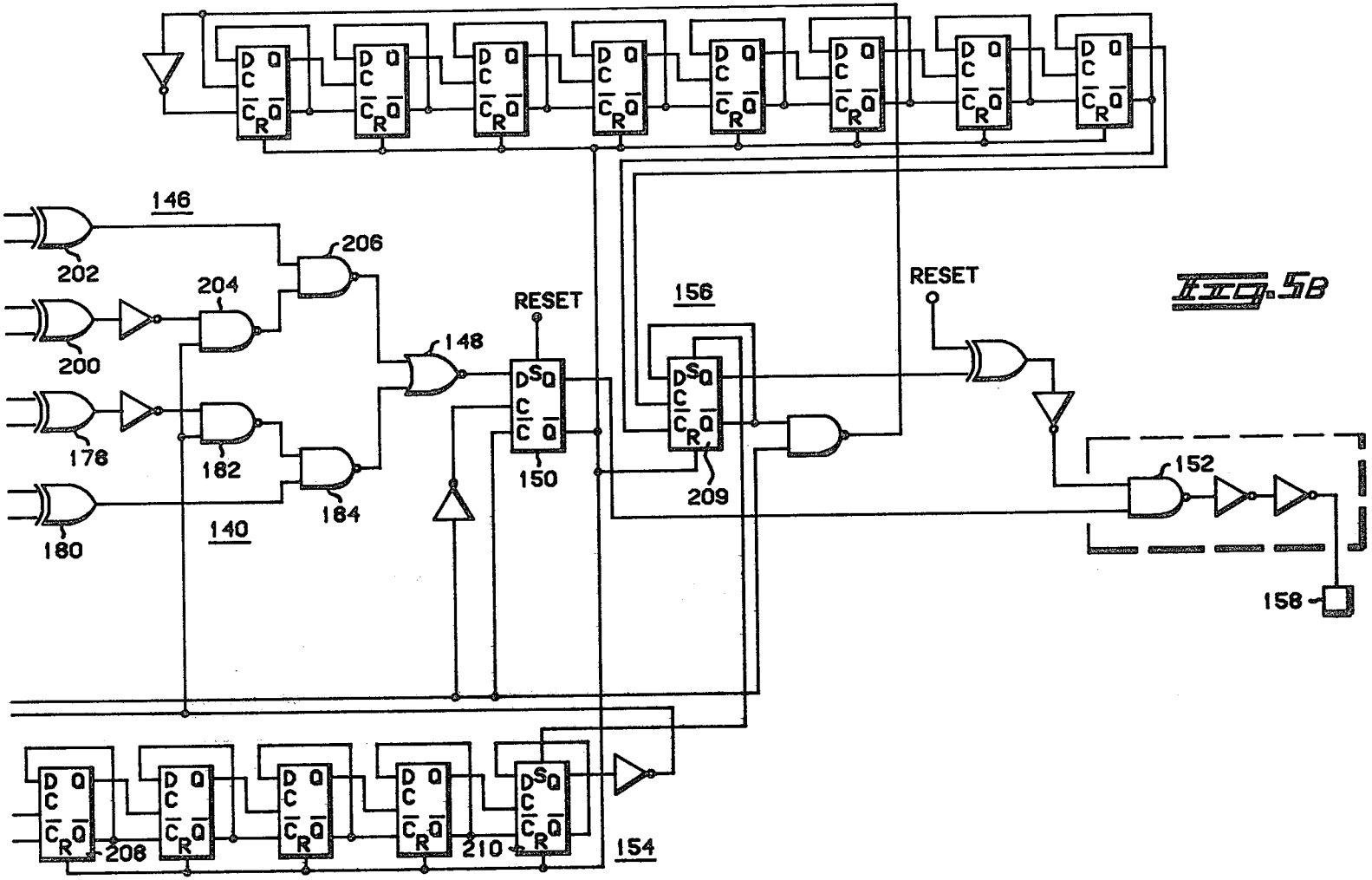

FIG. 4 is a functional block diagram of an embodiment of the delta-modulation detector of FIG. 3 and FIG. 5 is a detailed circuit realization of the block diagram of FIG. 4. It was stated earlier that a circuit such as that of U.S. Pat. No. 3,995,225 could be used to detect the presence of delta modulation and that patent was incorporated herein by reference. The circuit of FIGS. 4 and 5 is an improvement over the circuit of the patent, containing advantages that will be described. In FIG. 4 a signal at terminal 132 is to be tested to see if it has been subjected to delta modulation. Referring again to FIG. 3, where the delta-modulation detector was placed at the output of the decoder, it should be evident that the presence of delta modulation at terminal 132 means that a signal has been decrypted successfully. If a digital signal is not decrypted then it will resemble noise with bits in two logical states distributed almost randomly. Delta modulation in contrast exhibits relatively long runs of bits in one direction followed by relatively long runs of bits in the other direction, in addition to short runs of noise. It is the presence of these long runs that is tested by the circuit of FIGS. 4 and 5. Returning to FIG. 4, the signal at terminal 132 is applied to a counter 134 which supplies two inputs to exclusive OR gate 136. The output of exclusive OR gate 136 will comprise long strings of binary signals in one direction or the other if the input signal at 132 was delta modulated. If it was not, the output of exclusive OR gate 136 will resemble binary noise. This output is taken to two places to test for correlation of the signals for frequencies in the middle of the voice band and at both ends of the voice band. Counter 138 receives the inputs that are to be tested for correlation of frequencies at the high and low ends of the voice band. It counts to 127, and its counts of 16, 32 and 64 are taken to a correlator 140, the output of which is high for maximum positive correlation or maximum negative correlation. The output of exclusive OR gate 136 is also taken to a spectral inverter 142 which applies to counter 144 a signal corresponding to frequencies in the middle of the voice band. The outputs for 16, 32 and 64 of counter 144 are applied to correlator 146 which also produces a high for maximum positive or negative correlation. The outputs of correlators 140 and 146 are combined in NOR gate 148, the output of which is clocked into flip-flop 150 to generate an output that is taken to OR gate 152 and as a reset signal to counters 154 and 156. Counter 154 is a short-dropout counter that counts to 16 to enable correlators 140 and 146. This enables a hystersis threshold. Counter 156 is a long-dropout counter. It counts clock pulses to 256 to provide an input signal to invert OR gate 152. A high output of OR gate 152, either from long-dropout counter 156 or from flip-flop 150, is the signal that the circuit is receiving delta modulation. Long-dropout counter 156 holds the detected signal for a few seconds to prevent a loss of indication that the circuit is receiving delta modulation if a proper signal is lost briefly through fading or noise bursts.

FIG. 5 is a detailed circuit realization of the block diagram of FIG. 4. In FIG. 5 corresponding sections of the circuit are given the same numbers as their counterparts in the block diagram of FIG. 4. In FIG. 5 a digital signal that is to be tested to see if it represents CVSD modulation is applied at terminal 132. It is applied then to shift register 134 which comprises two cascaded D flip-flops. A third D flip-flop is included in register 134 for use if additional delay is desired, but that third flip-flop is here not connected. The outputs of the first and second flip-flops are taken as inputs to exclusive OR gate 136 from which it is taken to counters 138 and 144. In counter 138, it is combined in NAND gate 168 with a clock pulse and is then applied to a 7-element counter of which flip-flop 170 is typical. The outputs of flip-flops 172 and 176 are taken as inputs to exclusive OR gate 178 and the outputs of flip-flops 174 and 176 are taken as inputs to exclusive OR gate 180. The output of exclusive OR gate 178, inverted and combined in NAND gate 182 with a hysteresis signal, is combined in invert OR gate 184 with the output of exclusive OR gate 180. This combination of gates comprises correlator 140 of FIG. 4.

The output of exclusive OR gate 136 is taken to spectral inverter 142 where it is combined in exclusive OR gate 186 with a clock pulse. Spectral inverter 142 includes a divider 143, a flip-flop that produces a clocking pulse at half the frequency of the incoming bit stream. This typically divides a 12-kHz bit rate to produce 6 kHz. The output of exclusive OR gate 186 is clocked in NAND gate 188 and is applied to flip-flop 192, which is the first of 7 cascaded flip-flops connected to comprise counter 144. The last three flip-flops 194, 196 and 198 supply inputs to correlator 146. The outputs of flip-flops 194 and 198 are taken to exclusive OR gate 200. The outputs of flip-flops 196 and 198 are taken to exclusive OR gate 202. The output of exclusive OR gate 200 is inverted and applied along with a hysteresis signal to NAND gate 204 to generate an output that is combined with the output of exclusive OR gate 202 in invert OR gate 206. The output of invert OR gate 206 is the output of correlator 146, which is combined with the output of correlator 140 in NOR gate 148. The output of NOR gate 148 is taken as an input to flip-flop 150, the output of which is taken as one input to invert OR gate 152.

The remaining portions of the circuit of FIG. 5 are counters 154 and 156. Counter 154 is a hysteresis timer that changes threshold limits in the correlation counters for the duration of the short dropout. Counter 156 is a long-dropout counter that holds the circuit in an indication that it is receiving delta-modulated signals through periods of fade or noise bursts. Counters 154 and 156 are reset by the low output of flip-flop 150. Counter 156 may also be set by an external signal to stop counting if received signal is lost. Counter 156 comprises nine D flip-flops of which the last flip-flop 209 is allowed to clock by a pulse derived from outside the circuit. The last flip-flop of counter 154, flip-flop 210, generates a hysteresis signal that is applied as an input to NAND gates 182 and 204. Counter 157 comprises 8 flip-flops connected as a counter with the input appearing as clock pulses and inverted clock pulses at flip-flop 212. The final flip-flop of the counter is flip-flop 214. Its output is taken to a flip-flop 216. The buffered output of flip-flop 216 supplies a reset pulse for counters 138 and 144 and also clocks flip-flops 150. The output of flip-flop 150, taken through inverter OR gate 152 to terminal 158, provides an indication that can be used to squelch, a receiver if a decryption process provides a signal that does not have delta modulation. In addition, the circuit has features that cause it to continue to provide an indication of delta modulation despite brief losses due fading or noise. If a received transmission provides an indication of delta modulation for a time and then the indication disappears for a sufficiently long period of time, of the order of three seconds, the circuit of FIG. 5 will time out and squelch the receiver. This may happen, for example, if there is a loss of key synchronization in decryption.

We claim:

1. A method for automatically selecting a proper key from among a plurality of different keys for decrypting an encrypted digital signal consisting of a delta modulated digital voice signal wherein the voice signal is encrypted by a given key, the method comprising:

a. simultaneously decrypting the encrypted digital signal according to certain ones of the plurality of different keys;

b. testing the decrypted signals produced by said certain ones for said delta modulation characteristic;

c. developing a control signal responsive to detection of a decrypted signal having said delta modulation characteristic; and d. using the control signal to control audio heard by a user so that the user only hears audio corresponding to a decrypted signal having said delta modulation characteristic, whereby audio corresponding to signals decrypted with other than the proper key is not heard.

2. The method of claim 1 wherein the delta-modulation is continuously variable-slope delta modulation.

3. The method of claim 1 comprising in addition the step of repeating testing of the signal decrypted according to each of the plurality of keys at a periodic rate.

4. The method of claim 1 comprising in addition the step of automatically visually identifying the key that corresponds to said control signal thereby indicating the proper key.

5. An apparatus for automatic selection of a proper key from among a plurality of different keys for decrypting an encrypted digital signal consisting of a delta modulated digital voice signal wherein the voice signal is encrypted by a given key, the apparatus comprising:

a. means for simultaneously decrypting the encrypted digital signal according to certain ones of the plurality of keys;

b. means for testing the decrypted signals produced by said certain ones for said delta modulation characteristic;

c. means for developing a control signal in response to a decrypted signal containing said delta modulation characteristic; and d. means for enabling output audio in response to said control signal whereby no audio corresponding to signals decrypted with other than the proper key is produced.

6. The apparatus of claim 5 comprising in addition means for automatically visually identifying the key selected.

7. An apparatus for automatic selection of a proper key for decrypting a voice signal that has been subjected to delta modulation and encrypted according to one of first and second decryption keys, the apparatus comprising:

a. a first encode-decode module capable of decrypting according to a first key, the first encode-decode module receiving the encrypted data and decrypting according to the first key;

b. a first detector of delta modulation connected to the first encode-decode module to receive a signal from the first encode-decode module and test that signal for the presence of delta-modulation;

c. a second encode-decode module adapted to decrypt signals according to a second key different from the first key, the second encode-decode module receiving the encyrpted signal and simultaneously decoding it according to the second key while said first module decrypts the encrypted signal with the first key;

d. a second detector of delta-modulation connected to the second encode-decode module and receiving an output signal from the second encode-decode module to test it for the presence of delta-modulation;

e. a control matrix connected to the first and second detectors of delta-modulation and responsive to signals from the first and second detectors of delta-modulation to generate a control signal in response to a detected signal containing delta modulation; and f. a switch matrix connected to the first and second encode-decode modules and to the control matrix to enable passage of an output signal from one of the first and second encode-decode modules that produces a signal containing delta-modulation.

8. The apparatus of claim 7 comprising in addition a visual indicator connected to the first and second detectors of delta modulation and responsive to signals therefrom to indicate visually that one of the first and second encode-decode modules is producing a signal that contains delta modulation.

9. The apparatus of claim 8 wherein each of the detectors of delta modulation comprises:

a. a three-bit register connected to one of the encode-decode modules and receiving from it a signal that has been subjected to decryption according to a particular key, the three-bit register producing two outputs differing in time by a period of one bit;

b. a first exclusive OR gate receiving as inputs the outputs of the three-bit register;

c. a six-bit counter connected to the first exclusive OR gate and producing as outputs three most significant bits;

d. a first correlator connected to the outputs of the first counter to produce an indication of correlation of bits from the first counter;

e. a spectral inverter connected to the output of the first exclusive OR gate to produce an inverted spectrum of the output of the first exclusive OR gate;

f. a second six-bit counter connected to the spectral inverter and receiving as an input the output of the spectral inverter, the second six-bit counter producing three outputs corresponding to most significant bits;

g. a second correlator connected to the outputs of the second six-bit counter to produce an indication of correlation of the inverted spectrum;

h. a NOR gate connected to the first and second correlators and producing an output in response to signal from the first and second correlators;

i. a flip-flop connected to the NOR gate and producing an output signal in response to a signal from the NOR gate;

j. a long-drop counter connected to the flip-flop and reset by an output from the flip-flop, the long-drop counter providing a signal that maintains unchanged an indication of correlation for a predetermined interval of loss of signal;

k. a hysteresis counter connected to the flip-flop and the first and second correlators and reset by a signal from the flip-flop, the hysteresis counter producing a signal that changes detection thresholds in the first and second correlators; and l. an inverter OR gate connected to the flip-flop and the long-dropout counter and producing an output signal in response to inputs from the flip-flop and the long-dropout counter, which output indicates the detection of delta modulation in the input signal.

* * * * *